US005831399A

United States Patent [19]

Ohta et al.

[11] Patent Number: 5,831,399

[45] Date of Patent: Nov. 3, 1998

[54] COLOR PICTURE TUBE APPARATUS

[75] Inventors: Kazunori Ohta; Masahide Yamauchi; Yasuyuki Ueda, all of Osaka; Masahiko Sukeno, Hyogo, all of Japan

[73] Assignee: Matsushita Electronics Corporation, Osaka, Japan

[21] Appl. No.: 772,387

[22] Filed: Dec. 23, 1996

[30] Foreign Application Priority Data

Dec. 27, 1995 [JP] Japan ..... 7-341556

[51] Int. Cl.[6] ..... G09G 1/04; H01J 29/50

[52] U.S. Cl. ..... 315/382.1; 313/414

[58] Field of Search ..... 315/382, 382.1, 315/14; 313/414

[56] References Cited

U.S. PATENT DOCUMENTS

| | | | |
|---|---|---|---|
| 4,814,670 | 3/1989 | Suzuki et al. | 315/15 |
| 4,886,999 | 12/1989 | Yamane et al. | 313/414 |
| 4,945,284 | 7/1990 | Shimoma et al. | 313/414 |
| 5,519,290 | 5/1996 | Sugawara et al. | 315/382.1 |

FOREIGN PATENT DOCUMENTS

| | | |
|---|---|---|
| 55-021832 | 2/1980 | Japan . |
| 55-141051 | 11/1980 | Japan . |
| 59-111237 | 6/1984 | Japan . |
| 61-099249 | 5/1986 | Japan . |
| 1-232643 | 9/1989 | Japan . |
| 3-093135 | 4/1991 | Japan . |
| 3-095835 | 4/1991 | Japan . |
| 7-006709 | 1/1995 | Japan . |

*Primary Examiner*—Gregory C. Issing
*Attorney, Agent, or Firm*—Merchant, Gould, Smith, Edell, Welter & Schmidt, P.A.

[57] ABSTRACT

A color picture tube apparatus comprises cathodes, a control electrode, an accelerating electrode, a first focusing electrode, a second focusing electrode and a final accelerating electrode, a voltage applying means which applies a dynamic voltage which increases with increasing deflection angle to the second focusing electrode, a resistor which is connected between the first and second focusing electrodes. Electron beam through holes that are vertically oblong are provided at the facing sides of the second focusing electrode and the final accelerating electrode. A quadrupole electric field lens is formed wherein a focusing effect is obtained in the horizontal direction and a diverging effect is obtained in the vertical direction when the potential level of the second focusing electrode is higher than that of the first focusing electrode. A compensating means generates a combined focusing effect of the electric field lenses formed between the cathodes and the final accelerating electrode stronger in the horizontal direction than in the vertical direction when the potential levels of the first and second focusing electrodes are the same.

11 Claims, 17 Drawing Sheets

COLOR PICTURE TUBE APPARATUS

FIELD OF THE INVENTION

This invention relates to a color picture tube apparatus in which a high resolution picture image can be displayed over the entire region of a phosphor screen.

BACKGROUND OF THE INVENTION

In a conventional color picture tube apparatus, the so-called self-convergence system has been widely used in order to converge three electron beams which hit each phosphor material emitting red, green or blue, respectively in the entire region of a phosphor screen. In the self-convergence type color picture tube apparatus, when an optimum voltage is maintained to obtain a circular beam spot having a small radius in the center portion of a phosphor screen, electron beams are focused optimally in the horizontal direction at the peripheral portion on the phosphor screen, however, the electron beams are over-focused in the vertical direction. As a result, it is difficult to obtain a preferable beam spot and resolution picture image at the peripheral portion on the phosphor screen. In order to solve this problem, conventional examples to maintain the optimum focusing state for electron beams both in the horizontal and the vertical directions over the entire region of phosphor screen are disclosed as follows.

A first prior art is disclosed in Japanese Laid Open Patent No. (Tokkai-Sho) 61-99249. According to this prior art, a quadrupole lens electric field is formed where focusing effects in the horizontal direction and diverging effects in the vertical direction are enhanced with increasing deflection angle of electron beams. A main lens electric field is also formed where the focusing effect is weakened with increasing deflection angle of electron beams.

A second prior art is disclosed in Japanese Laid Open Patent No. (Tokkai-Hei) 7-6709. According to this prior art, a base focus voltage is divided into an anode voltage using a resistor having a high resistance placed inside the tube and only a dynamic focus voltage which increases with increasing deflection angle of electron beam is applied externally.

A third prior art is disclosed in Japanese Laid Open Patent No. (Tokkai-Hei) 1-232643. According to this prior art, as shown in FIG. 15, a resistor 7 having a resistance of about 200 kΩ is connected between a first focusing electrode 4 and a second focusing electrode 5, and a dynamic focus voltage which increases with increasing deflection angle of electron beam is applied to the second focusing electrode 5.

FIGS. 16 and 18 show electronic lens systems formed by the structure of the electron gun as an equivalent optical lens systems. FIG. 16 shows electronic lens systems formed by the structure of the electron gun to which only a base focus voltage Vc is applied to the second focusing electrode, that is, a dynamic voltage Vp is not superimposed on the base focus voltage. FIG. 18 shows electronic lens systems formed by the structure of the electron gun to which a dynamic focus voltage Vd, in which a dynamic voltage Vp is superimposed on the base focus voltage Vc, is applied to the second focusing electrode. In FIGS. 16 and 18, (a) indicates the lens structure in the horizontal direction at the center portion of the phosphor screen, (b) indicates the lens structure in the vertical direction at the center portion of the phosphor screen, (a') indicates the lens structure in the horizontal direction at the peripheral of the phosphor screen and (b') indicates the lens structure in the vertical direction at the periphery of the phosphor screen.

As shown in FIG. 16, when a constant base focus voltage Vc on which a dynamic voltage Vp is not superimposed is applied, the effect of a diverging lens 13 in the horizontal direction and the effect of focusing lens 14 in the vertical direction are generated at the periphery of the phosphor screen 12 due to the deflection magnetic field. The distance between the phosphor screen 12 and the main lens 11 becomes larger at the periphery of the phosphor screen 12, however, the distance is compensated by the effects of the diverging lens 13 in the horizontal direction due to the deflection magnetic field. As a result, electron beams can be focused optimally in the horizontal direction. Consequently, in the horizontal direction, electron beams can be focused optimally over the entire region of the phosphor screen.

On the other hand, in the vertical direction, the distance between the phosphor screen 12 and the main lens 11 becomes larger and electron beams are over-focused at the peripheral of the phosphor screen 12 due to the focusing lens 14 of the deflection magnetic field. In this case, as shown in FIG. 17, halo 15 occurs at upper and lower sides of the beam spot and the beam spot is vertically oblong.

As shown in FIG. 18, when a dynamic focus voltage Vd on which a dynamic voltage Vp is superimposed is applied to the second focusing voltage, beam spots can be focused both in the horizontal and vertical directions. As a result, the circular beam spot having a small radius can be obtained as shown in FIG. 19. The reason will be explained below.

In the structure of electron gun as shown in FIG. 15, when a dynamic focus voltage Vd is applied to a second focusing electrode 5, a constant potential Vd1, which is lower than the peak of the dynamic voltage Vd and higher than a base focus voltage Vc, is generated at a first focusing electrode 4 as shown in FIG. 5. Therefore, at the periphery of the phosphor screen 12, the potential Vd1 of the first focusing electrode 4 is lower than the potential Vd of the second focusing electrode 5. Three electron beam through holes that are vertically oblong are provided in the first focusing electrode 4 at the side facing the second focusing electrode 5. Three electron beam through holes that are horizontally oblong are provided in the second focusing electrode 5 at a side facing the first focusing electrode 4.

According to the above-mentioned structure, as shown in FIG. 18, a quadrupole lens electric field is formed between the first focusing electrode 4 and the second focusing electrode 5 where the effect of the focusing lens 20 is obtained in the horizontal direction and effect of the diverging lens 21 is obtained in the vertical direction is formed between the first focusing electrode 4 and the second focusing electrode 5. The strength of the main lens electric field, which is formed between the second focusing electrode 5 and the final accelerating electrode 6 by the dynamic focus voltage Vd applied to the second focusing electrode 5, is weakened with increasing deflection angle of electron beams.

Therefore, at the periphery of the phosphor screen 12, in the horizontal direction, the effect of the weakened main lens electric field 17 and that of the focusing lens 20 of the quadrupole lens electric field cancel each other, and as a result, electron beams can be focused optimally. In addition to that, in the vertical direction, the over-focused electron beams are compensated by the effect of the weakened main lens field 17 and the diverging lens 21 of the quadrupole lens electric field, and therefore, in the vertical direction, electron beams can be focused optimally. As mentioned above, at the periphery of the phosphor screen, a circular beam spot having a small radius might be obtained and a high resolution picture image might be displayed.

However, according to the first prior art, it is required to apply two kinds of focus voltages, that is, a dynamic focus voltage which increases with increasing deflection angle of electron beams, and a base focus voltage which is not affected by the deflection angle of electron beams. The base focus voltage is identical with the dynamic focus voltage in the center portion of the phosphor screen when the deflection angle of the electron beams is zero.

In the second prior art, it is required to use a resistor having resistance on the order of giga ohm to reduce electric power consumed by the resistor dividing the high voltage, ranging from 25 kV to 30 kV. The resistor having such a high resistance is very expensive and it is not easy to secure reliability in electric properties and to withstand the applied voltage.

In the third prior art, there is another disadvantage. As shown in FIG. 5, when peak points of the dynamic focus voltage Vd applied to the second focusing electrode are indicated as points "a" and "a'" and points where the potential of the first focusing electrode Vd1 coincides with Vd are indicated as points "b" and "b'", voltage Vd1 generated at the first focusing electrode is smaller than Vd between point a and point b, and between point b' and point a'. However, Vd1 is larger than Vd between point b and point b'. As shown in (a) and (b) of FIG. 18, between point b and point b' including the center portion of phosphor screen, a quadrupole lens electric field is formed between the first and second focusing electrodes where the effect of the diverging lens 18 is obtained in the horizontal direction and the effect of the focusing lens 19 is obtained in the vertical direction. As a result, electron beams are slightly under-focused in the horizontal direction and slightly over-focused in the vertical direction. Consequently, as shown in FIG. 20, near the center portion of the phosphor screen, the focusing state of the electron beams deviate slightly from the optimum focusing state so as to make the beam spot oval.

In the third prior art, the resistance of the resistor for smoothing is approximately 200 kΩ, which is not large enough in comparison with an impedance due to interelectrode capacitance, and as a result, a quadrupole lens electric field is formed imperfectly. Consequently, the state of the beam spot focused in the center portion of phosphor screen deviates from the optimum focus state both in the horizontal and the vertical directions. As a result, it is difficult to obtain a high resolution picture image displayed over the entire region of phosphor screen.

SUMMARY OF THE INVENTION

This invention aims to provide a color picture tube apparatus that can display a high resolution picture image over the entire region of a phosphor screen without using a resistor having a high resistance to obtain a focus voltage by dividing an anode voltage, and without applying two different focus voltages externally.

According to this invention, a color picture tube apparatus is provided that comprises a group of electrodes consisting of three cathodes which are in-line aligned in the horizontal direction, a control electrode, an accelerating electrode, a first focusing electrode, a second focusing electrode and a final accelerating electrode, means applying a dynamic voltage which increases with increasing deflection angle to the second focusing electrode, a resistor which is connected between the first and second focusing electrodes, means forming a quadrupole electric field lens where a focusing effect is obtained in the horizontal direction and a diverging effect is obtained in the vertical direction and an electric field lens compensating means to make combined focusing effects of electric field lenses formed between the cathodes and the final accelerating electrodes stronger in the horizontal direction than those in the vertical direction.

It is preferable that the electric field lens compensating means is made of electron beam through holes that are vertically oblong provided in the second focusing electrode and the final accelerating electrode at a side facing each other. It is also preferable that the electric field lens compensating means is made of electron beam through holes that are vertically oblong provided in the control electrode.

According to the above-mentioned structure, a direct potential having a value smaller than a peak value of the dynamic focus voltage applied to the second focusing electrode is generated at the first focusing electrode by the ratio of the capacitance formed between the accelerating electrode and the first focusing electrode and that formed between the first and second focusing electrodes. With increasing deflection angle of electron beams, a potential difference forms and a quadrupole electric field lens is formed where a focusing effect is obtained in the horizontal direction and a diverging effect is obtained in the vertical direction. Further, the focusing effect of a main lens electric field formed between the final accelerating electrode and the second focusing electrode to which the dynamic focus voltage is applied is weakened with increasing deflection angle of electron beams. The quadrupole lens electric field and the main lens electric field compensate the excessive focusing due to the magnetic field in the vertical direction. As a result, electron beams can be focused optimally both in the horizontal and vertical directions over the entire region of a phosphor screen.

In addition, when the potential level of the first focusing electrode is identical to that of the second focusing electrode, a combined focusing effect of the electric field lens formed by the electron gun is stronger in the horizontal direction than in the vertical direction. Therefore, a quadrupole lens electric field where a diverging effect is obtained in the horizontal direction and a focusing effect is obtained in the vertical direction can be cancelled by the main lens electric field where the focusing effect in the horizontal direction is strong and that in the vertical direction is weak.

It is preferable that a potential generated at a first focusing electrode is constant in order to obtain the above-mentioned quadrupole lens electric field, and the potential generated at the first focusing electrode is determined by the ratio of the capacitance formed between an accelerating electrode and a first focusing electrode and that formed between a first and second focusing electrodes. Therefore, it is preferable that the accelerating electrode is connected with the first focusing electrode via a capacitance element.

It is preferable that the quadrupole electric field lens forming means comprises electron beam through holes that are vertically oblong provided in the first focusing electrode at a side facing the second focusing electrode and those that are horizontally oblong provided in the second focusing electrode at a side facing the first focusing electrode.

It is preferable that at least one of the facing sides of the first and second focusing electrodes has projecting portions erected from the surface adjacent to the longer side of electron beam through holes and projected toward the other electrode.

According to the above-mentioned structure, capacitance formed between the first and the second focusing electrodes which forms a quadrupole electric field lens can be reduced. Instead of the projection portions, rectangular tube portions which are formed by projecting the surface toward the other side of the surface to surround electron beam through holes may be provided.

Further, at least one of the resistor or the capacitance element may be placed outside of the picture tube. According to the structure, the loss of vacuum of the picture tube due to the gas released from the resistor or the capacitance element can be avoided. Concretely, it is preferable that a resistor is connected between connecting pins for the first and second focusing electrodes.

Further, the resistor may be connected between the terminals for the first and second focusing electrodes in a socket portion which is connected with an outer pins of stem that closes a neck portion of the picture tube.

Further, resistive paste may be applied between contact holes of connecting pins for the first and second focusing electrodes in a base disposed between a stem that closes a neck portion of the picture tube and a socket connected to the outer pins.

DETAILED DESCRIPTION OF THE INVENTION

Figure 1:
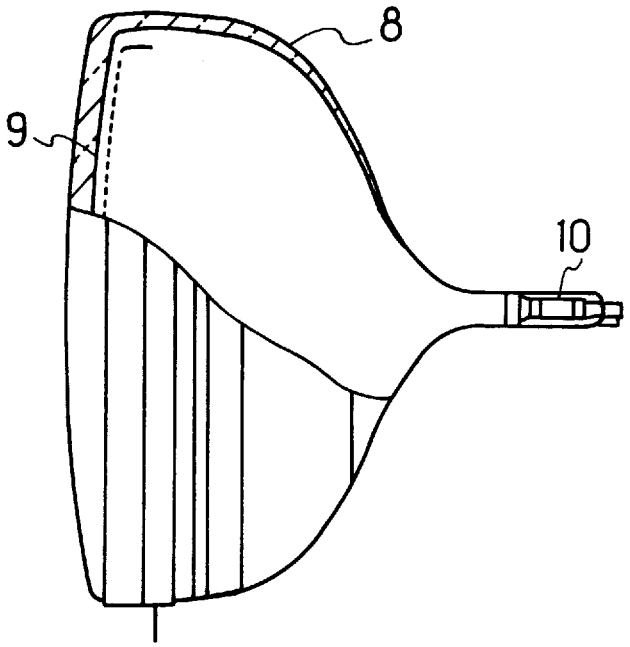
FIG. 1 is a partially cross sectional view showing a whole color picture tube according to this invention.

Hereinafter, embodiments of this invention will be explained referring to the drawings. As shown in FIG. 1, the color picture tube apparatus comprises an envelope 8 that includes a panel and funnel, and a phosphor screen 9 with which a phosphor emitting blue, green or red, respectively, is coated is provided at the inside of the panel. In addition, an electron gun 10 is contained inside of the neck portion of the envelope 8 facing the phosphor screen 9.

First embodiment

Figure 2:
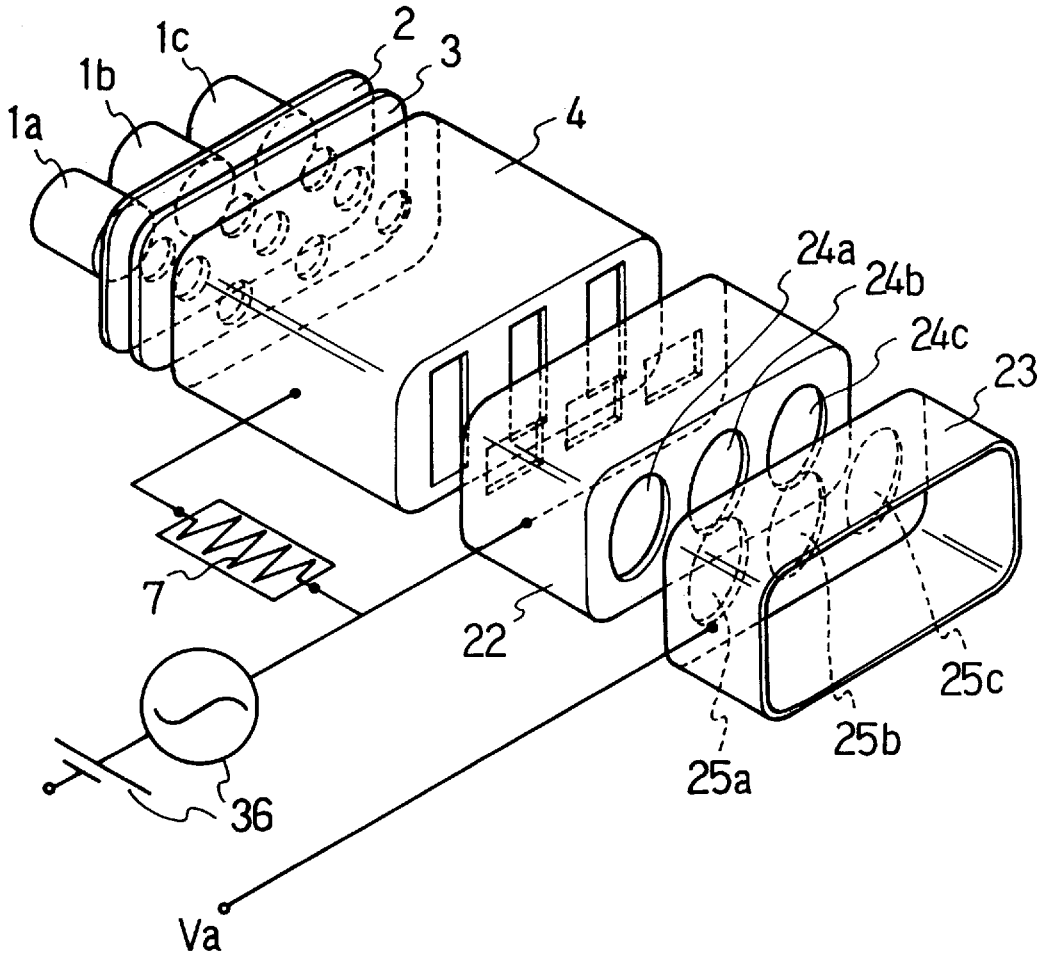
FIG. 2 is a perspective view showing a structure of an electron gun of a color picture tube apparatus of this first embodiment according to this invention.

As shown in FIG. 2, an in-line electron gun of the in-line color picture tube apparatus has three cathodes 1*a*, 1*b* and 1*c* which are horizontally aligned, a control electrode 2, an accelerating electrode 3, a first focusing electrode 4, a second focusing electrode 22 and a final accelerating electrode 23. Three electron beam through holes that are oblong vertically are provided in the first focusing electrode 4 at a side facing the second focusing electrode 22. Three electron beam through holes that are oblong horizontally are provided in the second focusing electrode 22 at a side facing the first focusing electrode 4. Three electron beam through holes that are oblong vertically are provided in the second focusing electrode 22 at a side facing the final accelerating electrode 23. Three electron beam through holes that are oblong vertically are provided in the final accelerating electrode 23 at a side facing the second focusing electrode 22. Three electron beam through holes that are circular are provided in the control electrode 2, the accelerating electrode 3 and the first focusing electrode 4 at a side facing the accelerating electrode 3, respectively.

In one embodiment, the size of electron beam through hole provided in each electrode and the thickness of each electrode are predetermined as follows.

The minimum width of the openings of the control electrode ranges from 0.3 to 0.7 mm, the thickness of the control electrode ranges from 0.05 to 0.09 mm, the size of hole provided in the accelerating electrode ranges from 0.3 to 0.7 mm, the thickness of the accelerating electrode ranges from 0.2 to 0.5 mm, and the size of hole provided in the first focusing electrode facing the accelerating electrode ranges from 0.7 to 1.2 mm. The electron beam through holes provided in the first focusing electrode 4 at a side facing the second focusing electrode 5 and those provided in the second focusing electrode 22 at a side facing the first focusing electrode 4 have a length of 4.5 mm in the longer side, have a length of 3.6 mm in the shorter side and have a rectangular shape. The distance between these electrodes is predetermined to be 0.7 mm.

A typical value of the direct current potential applied to each electrode in operating is shown as follows. A direct current potential ranging from 50 to 150 V, that of 0 V, that ranging from 300 to 700 V and that of 25 kV is applied to cathodes 1*a,* 1*b* and 1*c,* a control electrode 2, an accelerating electrode 3 and a final accelerating electrode 23 (Va), respectively.

Figure 3:
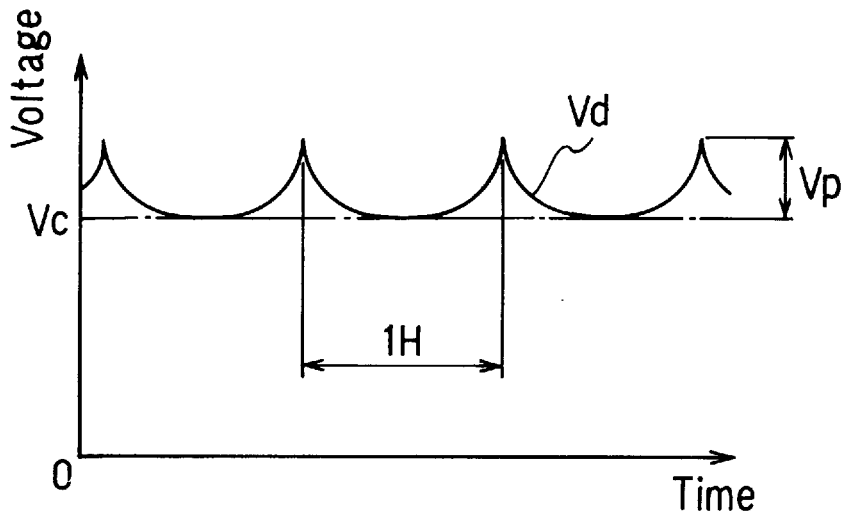
FIG. 3 shows a wave form of a dynamic focus voltage applied to the second focusing electrode as shown in FIG. 2

A voltage is applied to the second focusing electrode by a voltage applying means 36. As shown in FIG. 3, the wave-shape dynamic focus voltage, Vd, obtained by superimposing the voltage Vp which synchronizes with the electron beam deflection and changes to be parabolic-state on the base voltage Vc, is identical to 20 to 35% of the voltage Va, which is applied to the final accelerating electrode.

The distance between two peak points of the wave form of the dynamic focus voltage Vd is identical to one scanning period, 1H. Where the dynamic focus voltage Vd is identical with the base focus voltage Vc, the horizontal deflection angle is zero. As shown in FIG. 2, the first focusing electrode 4 is connected with the second focusing electrode 22 via resistor 7. The resistor 7 is placed inside the envelope 8.

Figure 4:
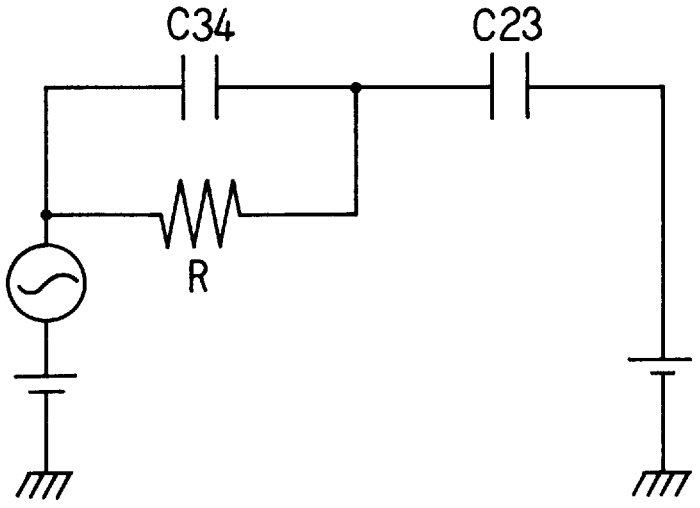
FIG. 4 shows an equivalent circuit of an electron gun as shown in FIG. 2.
Figure 5:
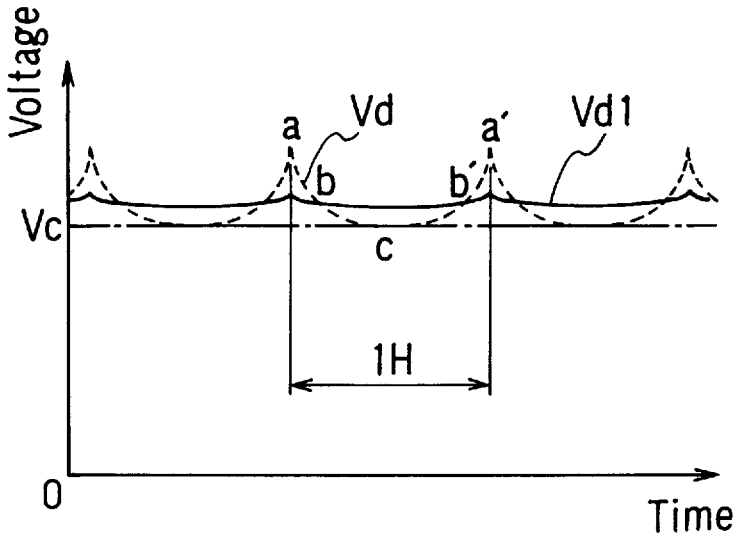
FIG. 5 shows a wave form of a potential generated at the first focusing electrode of an electron gun as shown in FIG. 2.

In the above-mentioned structure of the electron gun, capacitance (C23) is formed between the accelerating electrode 3 and the first focusing electrode 4 and capacitance (C34) is formed between the first focusing electrode 4 and the second focusing electrode 22. As a result, a circuit formed by capacitance coupling is formed shown as an equivalent circuit of FIG. 4. A first focusing electrode 4 is electrically connected with the accelerating electrode 3 via (C23). In an embodiment, (C23) and capacitance (C34) are about several pF. When the resistance value R of resistor 7 is large enough, for example, 10 MΩ, the voltage Vd1 which is constant, smaller than the peak voltage of the dynamic focus voltage Vd but larger than the base focus voltage Vc, as shown in FIG. 5, is generated at the first focusing electrode 4. Vd1, which depends on value of capacitance C23 and C34 and that of horizontal deflection frequency, is almost constant when the resistor 7 has a resistance of more than 5 MΩ.

In an embodiment, this invention intends to obtain the optimum focus of the electron beams near the center portion of the phosphor screen as follows.

As shown in FIG. 2, in the electron gun of the color picture tube apparatus, three electron beam through holes 24*a,* 24*b* and 24*c* that are oblong vertically (oval shaped) are provided in the second focusing electrode 22 at a side facing the final accelerating electrode 23. Three electron beam through holes 25*a,* 25*b* and 25*c* that are also oblong vertically are provided in the final accelerating electrode 23 at a side facing the second focusing electrode 22. In one embodiment, electron beam through holes provided in the first focusing electrode 4 at a side facing the second focusing electrode 22 and electron beam through holes provided in the second focusing electrode 22 at a side facing the first focusing electrode 4 are rectangular shape having a length of 4.5 mm in the longer side and of 3.6 mm in the shorter side. The distance between the first and the second focusing electrodes is 0.7 mm. The ratio of the longer side and the shorter side of the electron beam through holes provided in the second focusing electrode 22 at a side facing the final accelerating electrode 23 and those provided in the final accelerating electrode 23 at a side facing the second focusing electrode 22 ranges from 1.1 to 1.4.

Figure 6:
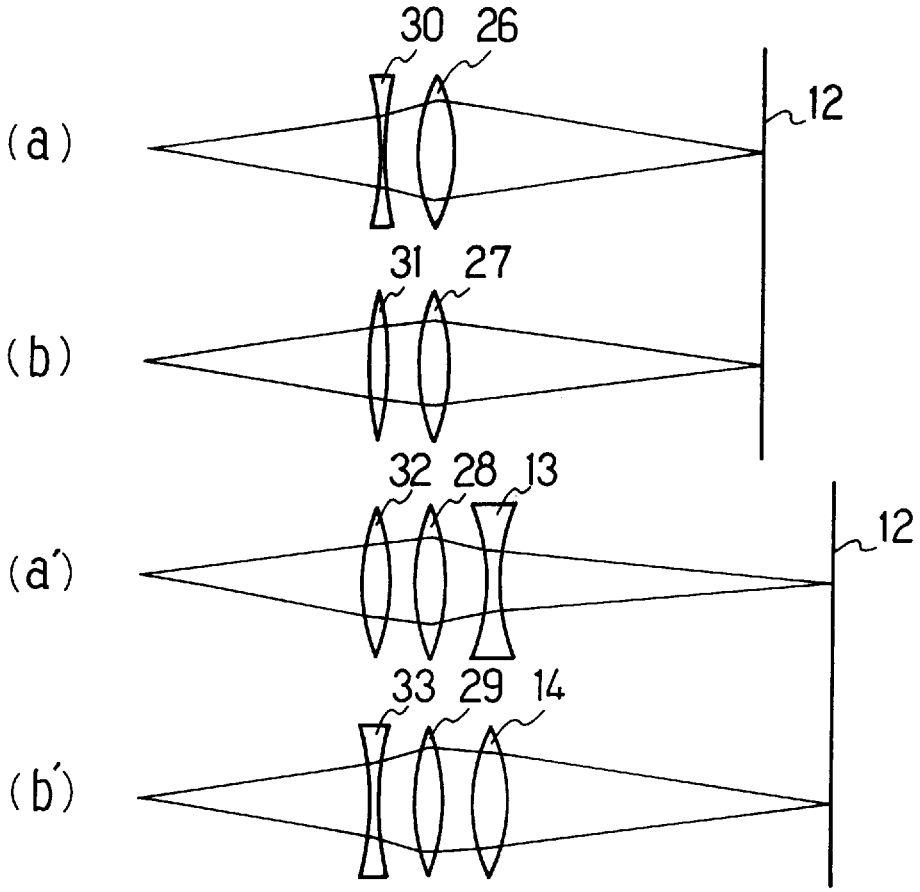
FIG. 6 shows an electron lens model both in the horizontal and the vertical directions at the center portion and the periphery of the phosphor screen when no dynamic voltage is applied in an electron gun as shown in FIG. 2.
Figure 8:
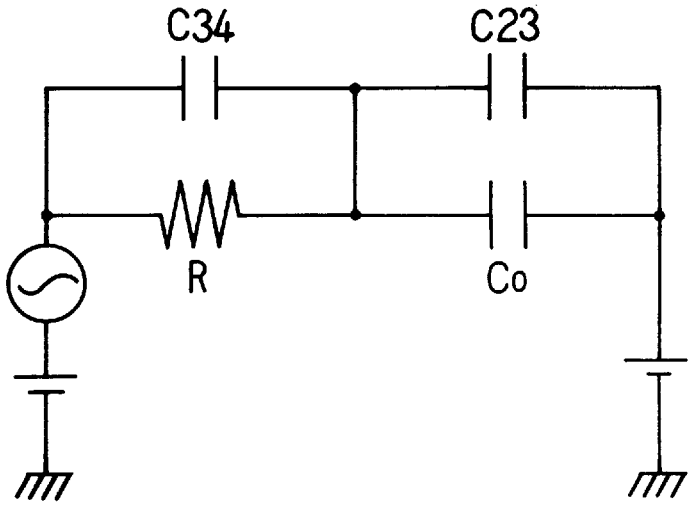
FIG. 8 shows an equivalent circuit of an electron gun as shown in FIG. 7.

FIGS. 6 and 8 show electronic lens systems formed by the structure of the electron gun as equivalent optical lens systems. In FIG. 6, (a) indicates the lens structure in the horizontal direction at the center portion of the phosphor screen, (b) indicates the lens structure in the vertical direction at the center portion of the phosphor screen, (a') indicates the lens structure in the horizontal direction at the periphery of the phosphor screen and (b') indicates the lens structure in the vertical direction at the periphery of the phosphor screen.

When a dynamic focus voltage as shown in FIG. 3 is applied to the second focusing electrode 22, a substantially constant potential Vd1 is generated at the first focusing electrode 4 as shown in FIG. 5. As a result, at the center portion of the phosphor screen 12, the potential Vd of the second focusing electrode 22 is smaller than the potential Vd1 of the first focusing electrode 4.

Therefore, in a quadrupole lens electric field formed between the first focusing electrode 4 and the second focusing electrode 22, the effect of the diverging lens 30 is generated in the horizontal direction and the effect of the focusing lens 31 is generated in the vertical direction. On the other hand, a main lens electric field, where the effect of the focusing lens 27 in the vertical direction is smaller than the effect of the focusing lens 26 in the horizontal direction, is formed between the second focusing electrode 22 and the final accelerating electrode 23. The above-mentioned state occurs because the shape of the electron beam through holes provided in the second focusing electrode 22 at a side facing the final accelerating electrode 23 and those provided in the final accelerating electrode 23 at a side facing the second focusing electrode 22 is vertically oblong. In these points, this embodiment is different from the third prior art.

The effect of the diverging lens 30 in the horizontal direction and the effect of the focusing lens 31 in the vertical direction comprising the quadrupole lens electric field are cancelled by the strong effect of the focusing lens 26 in the horizontal direction and the weak effect of the focusing lens 27 in the vertical direction comprising the main lens electric field. As a result, beam spots can be focused optimally both in the horizontal and the vertical directions.

At the periphery of the phosphor screen 12, the effect of the diverging lens 13 in the horizontal direction and the effect of the focusing lens 14 in the vertical direction are generated by deflection magnetic field. The potential of the second focusing electrode becomes larger than that of the first focusing electrode, as a result, a quadrupole lens electric field, where the effect of the focusing lens 32 is obtained in the horizontal direction and the effect of the diverging lens 33 is obtained in the vertical direction, is formed between the first focusing electrode 4 and the second focusing electrode 22. Since the potential of the second focusing electrode increases with increasing deflection angle of the electron beam, the effect of the focusing lens 28 and 29 of the main lens electric field is weakened by the increasing of the deflection angle of the electron beams. The distance between the phosphor screen 12 and the main lens is larger at the periphery of the the phosphor screen 12 than at the center portion of the phosphor screen 12, however, the difference of the distance is compensated by the effect of the diverging lens 13 in the horizontal direction due to the deflection magnetic field generated in the vertical direction. The effect of the focusing lens 14 in the deflection magnetic field generated in the vertical direction is cancelled by the effect of the diverging lens 33 of the quadrupole lens electric field and the weakened main lens electric field 29. As a result, electron beams can be focused optimally both in the horizontal and the vertical directions. As mentioned above, according to this invention, an optimum focusing state of electron beams can be maintained over the whole region of the phosphor screen and a circular beam spot having a small radius can be obtained.

According to this invention, a technique in which the electron beam through holes that are vertically oblong are provided in the second focusing electrode and the final accelerating electrode at a side facing each other as a means of electric field lens compensation to make the focusing effects of electric field lenses formed by the electron gun in the horizontal direction stronger than those in the vertical direction is disclosed, when the potential level of the first and the second focusing electrodes is same. However, it is not limited to the above-mentioned structure and any other technique may be employed. For example, a main lens which overlaps a lens electric field of center gun (G) and that of side gun (R, B) and a main lens whose axial electric field of electron gun is extended may be applied to this invention and a combined focusing effect of electric field lenses can be made stronger in the horizontal direction than those in the vertical direction.

Further, instead of making the focusing effect of the main lens stronger in the horizontal direction than that in the vertical direction, a technique which is disclosed in Japanese Laid Open Patent No. Tokkai-Sho 55-21832, No. Tokkai-Sho 55-141051 and No. Tokkai-Sho 59-111237 may be employed. According to the cathode-ray tube apparatus disclosed in Japanese Laid Open Patent No. Tokkai-Sho 55-21832, No. Tokkai-Sho 55-141051 and No. Tokkai-Sho 59-111237, at least one electron beam through hole that is non-circular shape is provided in a control electrode, an accelerating electrode and a first focusing electrode at a side facing an accelerating electrode. For example, electron beam through holes that are vertically oblong and rectangular shape, having a length of 0.3 mm in the horizontal direction and that of 0.4 mm in the vertical direction, may be provided.

However, in this case, the size of the vertically oblong electron beam through holes of the control electrode is small in the horizontal direction. Thus, the acting area of the cathode becomes small, thereby increasing current density, so that an object point becomes small in the horizontal direction. In addition, a cathode lens acts strongly so that an object point can be located near the cathode. On the contrary, the size of the vertically oblong electron beam through holes of the control electrode is large in the vertical direction, so that an object point becomes large in the vertical directions and an object point can be located far from the cathode. That is, the effects of the electric field lens in the horizontal direction become stronger than those in the vertical direction due to the difference between the object points generated in the vertically oblong electron beam through holes provided at the control electrode.

In this case, the pre-focusing effect is stronger and electron beams are strongly focused in the horizontal direction, however, in the vertical direction, the electron beams spot is expanded. Therefore, it is preferable that a slit-shaped plate is laminated on a surface of the accelerating electrode facing the first focusing electrode. As a result, the expansion of the electron beam spot in the vertical direction is controlled. Thereby, the combined focusing effect of electric field lenses formed by an electron gun becomes stronger in the horizontal direction than those in the vertical direction.

Second embodiment

As shown in FIG. 5 of the first embodiment, when a dynamic focus voltage Vd is applied to the second focusing electrode, the potential of the first focusing electrode becomes a substantially constant potential, Vd1, which is smaller than the peak of Vd but larger than a base focus voltage, Vc. It is preferable that the potential generated at the first focusing electrode, Vd1, is a constant direct current. The alternating current component which is superimposed on Vd1 is affected by capacitance C23 formed between the accelerating electrode and the first focusing electrode and as the value of the capacitance (C23) increases, the alternating current component is reduced. On the other hand, as the capacitance C34 formed between the first and the second focusing electrodes decreases, the alternating current component which is superimposed on Vd1 decreases. The capacitance formed between the electrodes depends greatly on the shape of the electrode, that is, the facing area and the distance between the electrode. However, in general, the capacitance formed between the electrodes is several pF and the shape of the electrode is formed in order to obtain the necessary characteristic of the electric field lens formed between the electrode. Consequently, it is difficult to increase the capacitance formed between the electrodes to a level as large as several hundred pF.

Figure 7:
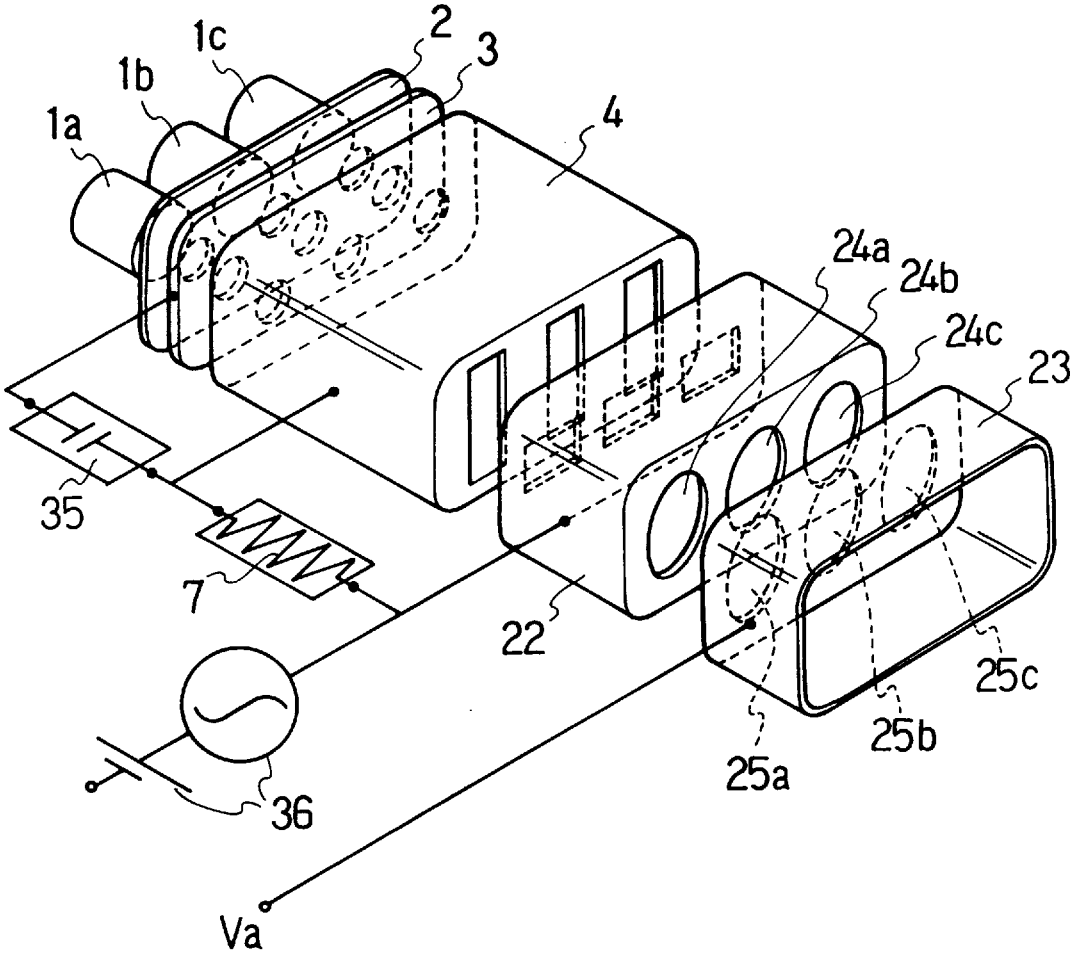
FIG. 7 is a perspective view showing a structure of an electron gun of a color picture tube apparatus of a second embodiment according to this invention.

In the second embodiment, the alternating component of the potential generated at the first focusing electrode as above-mentioned is reduced and the structure of the electron gun is shown in FIG. 7. An accelerating electrode 3 and a first focusing electrode 4 are connected via capacitance element 35 (capacitance Co) formed in an envelope. The structure of other electrodes and the applying voltage are identical with those of the first embodiment. In one embodiment, the capacitance Co of the capacitance element 35 is 150 pF.

Figure 9:
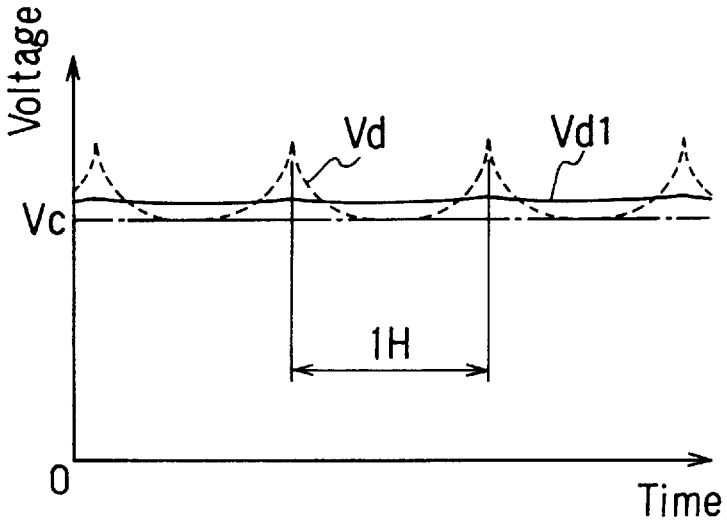
FIG. 9 shows a wave form of a potential generated at the first focusing electrode of an electron gun as shown in FIG. 7.

FIG. 8 shows an equivalent circuit formed by the above-mentioned structure of the electron gun. The capacitance Co and the capacitance C23 formed between the accelerating electrode 3 and the first focusing electrode 4 are connected in parallel and the capacitance formed between the accelerating electrode 3 and the first focusing electrode 4 increases actually. In this case, a potential generated at the first focusing electrode 4, Vd1, is a substantially constant direct current as shown in FIG. 9 and the alternating current component of the potential is reduced in comparison with Vd1 of the first embodiment.(FIG. 5) Therefore, slight gaps of the focusing state of the beam spot due to the alternating current component generated at the first focusing electrode 4 can be compensated.

The third embodiment

Figure 10A:
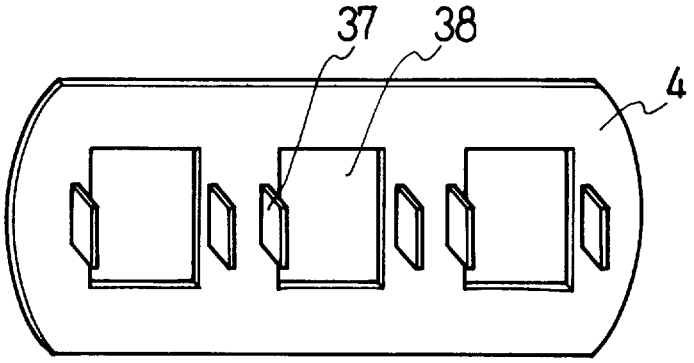
FIG. 10A is a perspective view showing projecting portions provided at the first focusing electrode to reduce capacitance between the first and second focusing electrodes.
Figure 10B:
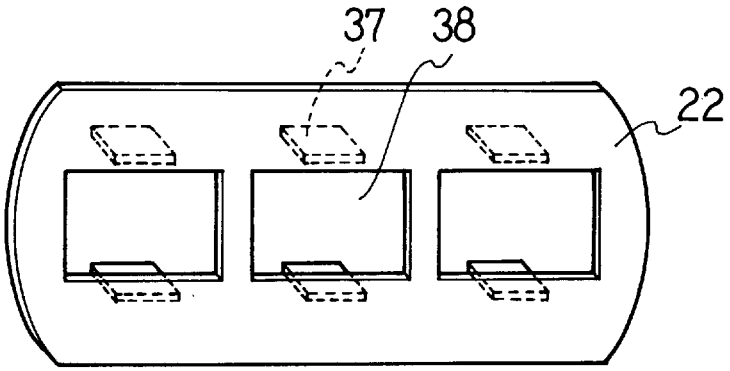
FIG. 10B is a perspective view showing projecting portions provided at the second focusing electrode to reduce capacitance between the first and second focusing electrodes.

In the third embodiment, an electrode structure in which C34 is reduced in order to reduce the alternating current component of the potential generated at the first focusing electrode is provided. As shown in FIG. 10A, a projecting portion 37 is provided at the longer side of electron beam through holes provided in the first focusing electrode 4 at a side facing the second focusing electrode 22. As shown in FIG. 10B, a projecting portion 37 is provided at the longer side of electron beam through holes provided in the second focusing electrode 22 at a side facing the first focusing electrode 4. When the distance between the first and second focusing electrodes is not changed, the effect of a quadrupole lens electric field formed between he first and second focusing electrodes become stronger.

The strength of the effect of a quadrupole lens electric field depends on a synergistic action of the shape of the electron beam through holes and that of the projection portion. That is, by providing a projection portion and expanding the distance between the sides, the same strength of the effect of a quadrupole lens electric field as that of a quadrupole lens electric field at which no projection portion 37 is provided can be obtained. As a result, the capacitance C34 formed between the first focusing electrode 4 and the second focusing electrode 22 is reduced. Consequently, the alternating current component generated at the first focusing electrode can be reduced.

Figure 11A:
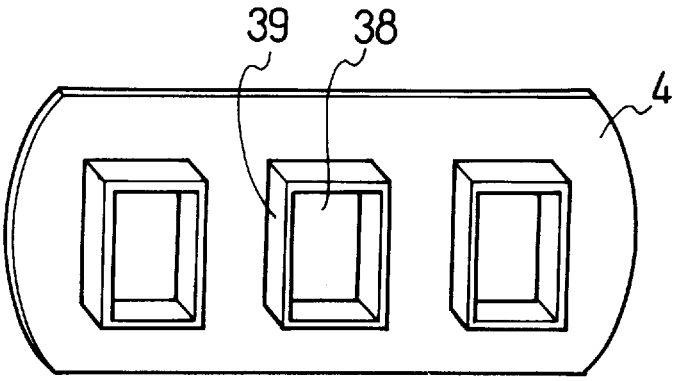
FIG. 11A is a perspective view showing rectangular tube portions provided at the first focusing electrode to reduce capacitance between the first and second focusing electrodes.
Figure 11B:
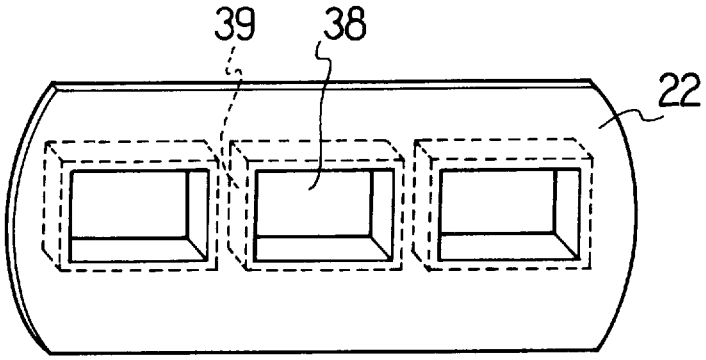
FIG. 11B is a perspective view showing rectangular tube portions provided at the second focusing electrode to reduce capacitance between the first and second focusing electrodes.

As shown in FIG. 11, in a case in which a rectangular tube portion 39 is provided surrounding the electron beam through hole 38 provided in the first focusing electrode 4 and the second focusing electrode 22 at a side facing each other, the same effect as that of the case as shown in FIG. 10 can be obtained.

Further, a quadrupole lens may be formed by providing a projection portion or a rectangular portion surrounding a circular electron beam through hole.

The fourth embodiment

In the above-mentioned embodiments, a resistor connecting between a first and second focusing electrodes or capacitance element connecting between an accelerating electrode and a first focusing electrode is provided inside the picture tube. However, when a resistor in which carbon is used as conductive material, CO, $C_2H_4$, $C_3H_6$, $CO_2$, or $C_4H_6$ is generated from the resistor and the degree of vacuum inside the tube might be reduced. The gas released from a resistor or capacitance element might shorten the lifetime of a vacuum device such as a color picture tube. In particular, the portion which is close to the cathode of electron gun of color picture tube is easily affected by the released gas, and therefore there is a high possibility to reduce the lifetime of the color picture tube.

In the fourth embodiment, a resistor or capacitance element is placed outside of the picture tube, and thereby the reduction of the degree of vacuum of picture tube can be avoided. Concretely, in a stem that closes a neck portion of the picture tube or a socket portion, a resistor is connected between terminals for first and second focusing electrodes. Alternatively, in a base disposed between the stem and the socket, a resistive paste may be applied between contact holes of connecting pins for first and second focusing electrodes.

Figure 12:
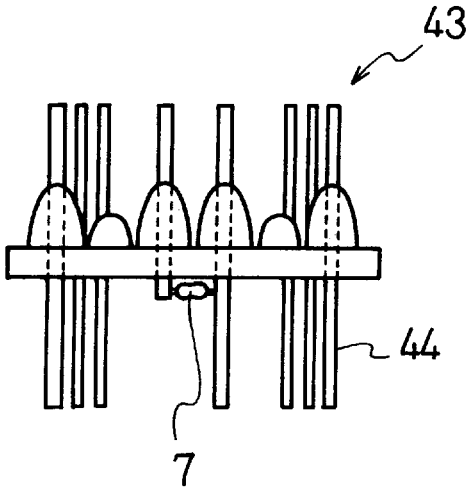
FIG. 12 is a side view showing a structure of outer pin portions of a stem at which a resistor connected between the first and second focusing electrodes is provided.

In FIG. 12, an example in which a resistor 7 is connected between connecting pins for first and second focusing electrodes in a stem portion 43 that closes the neck portion of picture tube facing an outer pin 44 side is shown.

Figure 13:
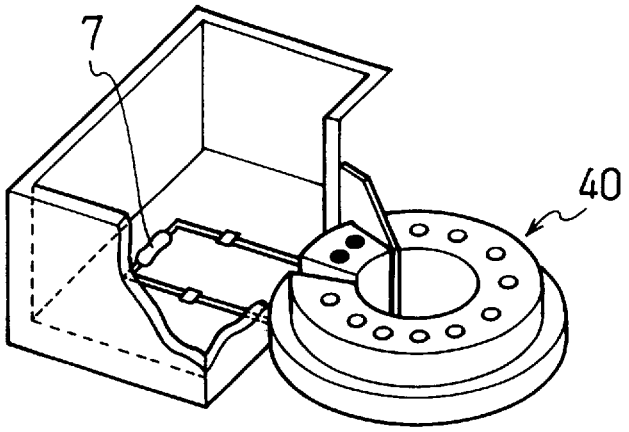
FIG. 13 is a perspective view showing a structure of a socket portion at which a resistor connected between the first and second focusing electrodes is provided.

In FIG. 13, an example in which a resistor 7 is connected between terminals for first and second focusing electrodes of a socket portion 40 connected to outer pins 44 of a stem portion 43 is shown.

Figure 14:
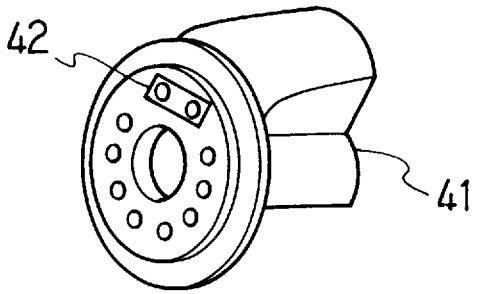
FIG. 14 is a perspective view showing a structure of a base portion at which a resistor connected between the first and second focusing electrodes is provided.
Figure 15:
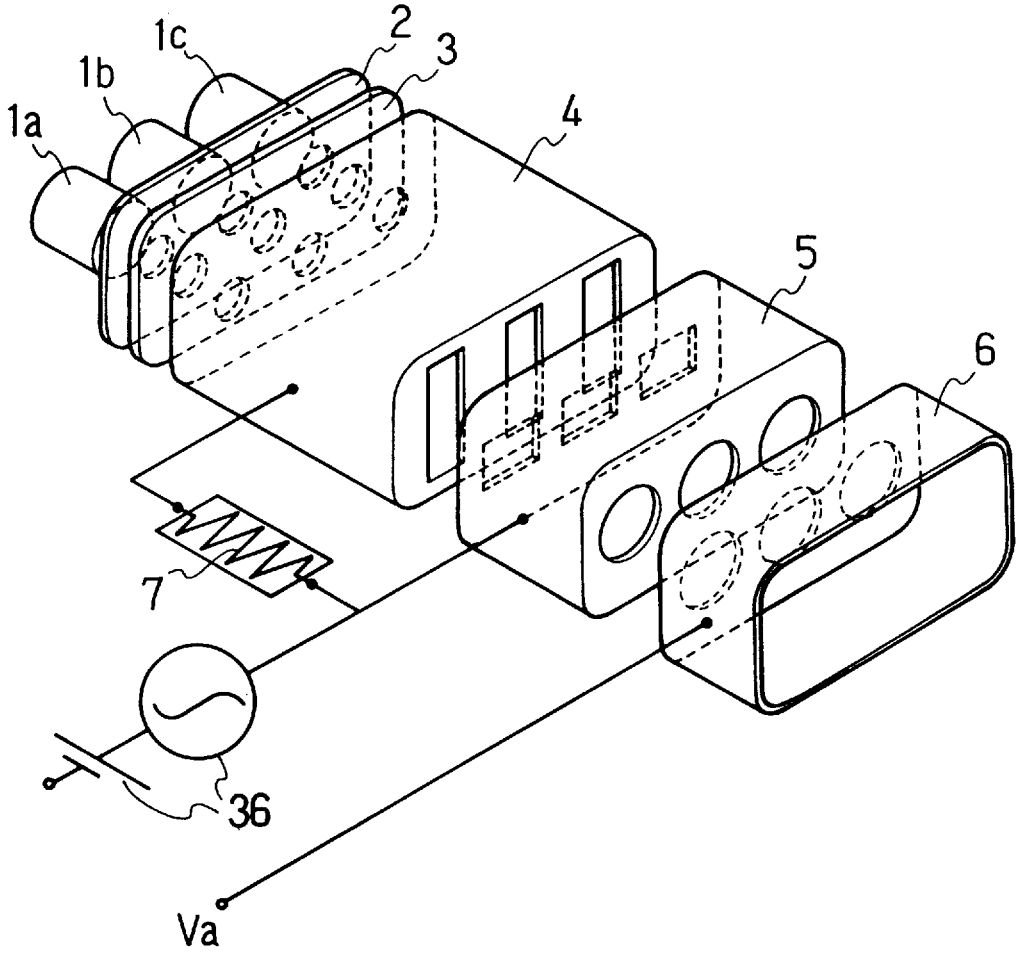
FIG. 15 (PRIOR ART)
FIG. 15 is a perspective view showing a structure of a conventional electron gun of color picture tube apparatus. embodiment
Figure 16:
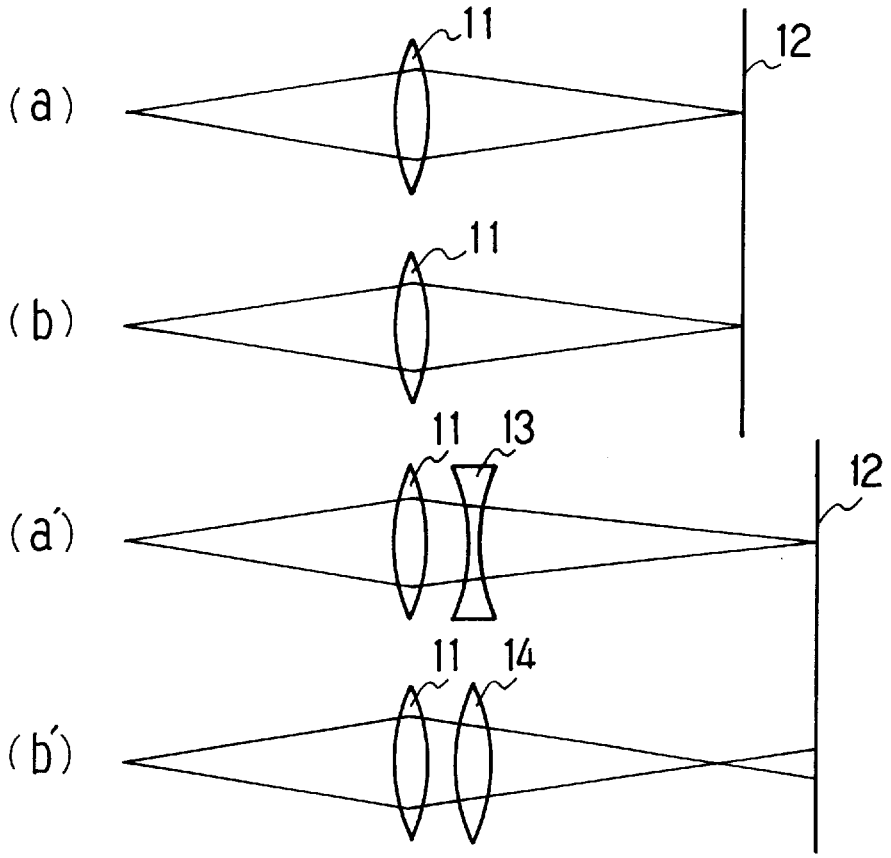
FIG. 16 (PRIOR ART)
FIG. 16 shows an electron lens model both in the horizontal and the vertical directions at the center portion and the periphery of the phosphor screen when no dynamic voltage is superimposed on a focus voltage in an electron gun as shown in FIG. 15.
Figure 17:
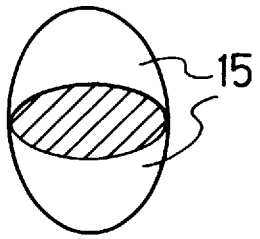
FIG. 17 (PRIOR ART)
FIG. 17 shows a shape of beam spot at the periphery of the phosphor screen when no dynamic voltage is superimposed on a focus voltage in an electron gun as shown in FIG. 15.
Figure 18:
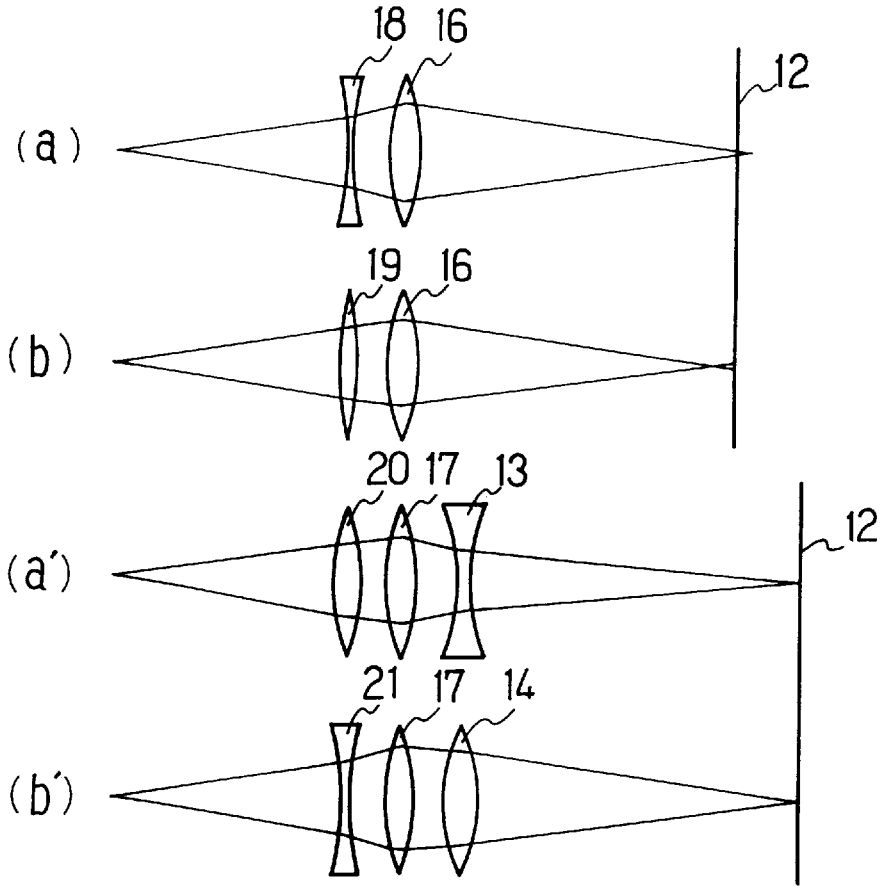
FIG. 18 (PRIOR ART)
FIG. 18 shows an electron lens model both in the horizontal and the vertical directions at the center portion and the periphery of the phosphor screen when a dynamic voltage is superimposed on a focus voltage in an electron gun as shown in FIG. 15.
Figure 19:
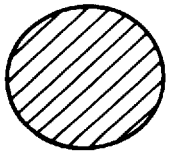
FIG. 19 (PRIOR ART)
FIG. 19 shows a shape of a beam spot at the periphery of the phosphor screen when a dynamic voltage is superimposed on a focus voltage in an electron gun as shown in FIG. 15.
Figure 20:
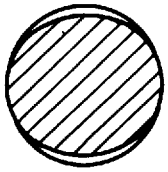
FIG. 20 (PRIOR ART)
FIG. 20 shows a shape of a beam spot at the center of the phosphor screen when a dynamic voltage is applied to a focus voltage in an electron gun as shown in FIG. 15.

In FIG. 14, an example in which resistive paste 42 is applied between contact holes of connecting pins for first and second focusing electrodes in a base portion 41 disposed between stem portion 43 and socket portion 40. After the resistive paste is applied, a base portion 41 is adhered to a stem portion 43 with insulating adhesive material. Ruthenium oxide based paste may be used as a resistive paste.

This invention can be applied not only to the electron gun having a quadrupole lens electric field formed between an accelerating electrode and a final accelerating electrode but also to a color picture tube having an electron gun in which a plurality of quadrupole fields are formed, as disclosed in Japanese Laid Open Patent No. Tokkai-Hei 3-93135 and No. Tokkai-Hei 3-95835. In addition to that, this invention can be applied to a color picture tube comprising an electron gun having one or a plurality of electrodes between an accelerating electrode and a first focusing electrode.

The electron guns disclosed in the above-mentioned prior arts comprise first and second auxiliary electrodes provided between the accelerating electrode and the first focusing electrode, the first auxiliary electrode and the first focusing electrode are connected by conductor and the second auxiliary electrode and the second focusing electrode are connected by conductor. In this case, a resistor may be connected not only between the first and second focusing electrodes but also between the first auxiliary electrode and the second focusing electrode. In addition, the resistor may be connected between the first and second auxiliary electrodes.

This invention may be applied to a color picture tube comprising an electrode gun having one or a plurality of electrodes. Concretely, two electrodes are provided between an accelerating electrode and a first focusing electrode ,a potential level of an electrode provided at the side of cathode is made to be as same as that of a first focusing electrode and a potential level of the other electrode is made to be as same as that of an accelerating electrode. In addition, a resistor is connected between first and second focusing electrodes. As a result, capacitance C23 generated between the accelerating electrode and the first focusing electrode is increased, an alternating current component of potential generated at the first focusing electrode is reduced, therefore the focusing state of electron beam is improved.

According to the explanation, a color picture tube apparatus of this invention can maintain the optimum focusing state of beam spots over the whole region of the phosphor screen without using a resistor having a high resistance to obtain a focus voltage by dividing an anode voltage and without applying two kinds of focus voltages externally, that is, only by applying a dynamic focus voltage. As a result, a high resolution picture image can be displayed over the whole region of the phosphor screen.

This invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, an all change which come within the meaning and range of equivalency of the claims are intended to be embraced therein.

What is claimed is:

1. A color picture tube apparatus comprising:

a group of electrodes including three cathodes which are in-line aligned in the horizontal direction, a control electrode, an accelerating electrode, a first focusing electrode, a second focusing electrode and a final accelerating electrode;

means for applying a dynamic voltage which increases with increasing deflection angle to the second focusing electrode;

a resistor which is connected between said first and second focusing electrodes;

means for forming a quadrupole electric field lens where a focusing effect is obtained in the horizontal direction and a diverging effect is obtained in the vertical direction when the potential level of said second focusing electrode is higher than that of said first focusing electrode; and means for compensating an electric field by making a combined focusing effect of electric field lenses formed between said cathodes and said final accelerating electrode stronger in the horizontal direction than in the vertical direction when the potential levels of said first and second focusing electrodes are the same.

2. The color picture tube apparatus according to claim 1, wherein said electric field lens compensating means comprises electron beam through holes that are vertically oblong provided at sides of said second focusing electrode and said final accelerating electrode facing each other.

3. The color picture tube apparatus according to claim 1, wherein said electric field lens compensating means comprises electron beam through holes that are vertically oblong provided in the control electrode.

4. The color picture tube apparatus according to claim 1, wherein said accelerating electrode is connected to said first focusing electrode via a capacitance element.

5. The color picture tube apparatus according to claim 1, wherein said quadrupole electric field lens forming means comprises electron beam through holes that are vertically oblong provided in the first focusing electrode at a side facing the second focusing electrode and electron beam through holes that are horizontally oblong provided in the second focusing electrode at a side facing the first focusing electrode, and at least one of facing sides of the first and second focusing electrodes has projecting portions erected from the surface adjacent to the longer sides of electron beam through holes and projected toward the other electrode.

6. The color picture tube apparatus according to claim 1, wherein said quadrupole electric field lens forming means comprises electron beam through holes that are vertically oblong provided in the first focusing electrode at a side facing the second focusing electrode and electron beam through holes that are horizontally oblong provided in the second focusing electrode at a side facing the first focusing electrode, and at least one of said first and second focusing electrodes have rectangular tube portions projecting toward the other electrode and surrounding the electron beam through holes.

7. The color picture tube apparatus according to claim 1, wherein said resistor is placed outside of the picture tube.

8. The color picture tube apparatus according to claim 4, wherein said capacitance element is placed outside of the picture tube.

9. The color picture tube apparatus according to claim 7, wherein a resistor is connected between connecting pins for the first and second focusing electrodes at outer pin portions of a stem that closes a neck portion of the picture tube.

10. The color picture tube apparatus according to claim 7, wherein said resistor is connected between terminals for the first and second focusing electrodes in a socket connected to outer pins of a stem that closes a neck portion of the picture tube.

11. The color picture tube apparatus according to claim 7, wherein resistive paste is applied between contact holes of connecting pins for said first and second focusing electrodes in a base disposed between a stem that closes a neck portion of the picture tube and a socket connected to outer pins of said stem.

* * * * *